US012258106B2

(12) United States Patent
Bruneau

(10) Patent No.: US 12,258,106 B2
(45) Date of Patent: Mar. 25, 2025

(54) TETHERLESS SHUTOFF SYSTEMS AND METHODS FOR POWERSPORT VEHICLES

(71) Applicant: TAIGA MOTORS INC., Lasalle (CA)

(72) Inventor: Samuel Bruneau, Montreal (CA)

(73) Assignee: TAIGA MOTORS INC., Lasalle (CA)

( * ) Notice: Subject to any disclaimer, the term of this patent is extended or adjusted under 35 U.S.C. 154(b) by 211 days.

(21) Appl. No.: 17/853,092

(22) Filed: Jun. 29, 2022

(65) Prior Publication Data

US 2023/0007882 A1 Jan. 12, 2023

Related U.S. Application Data

(60) Provisional application No. 63/219,117, filed on Jul. 7, 2021.

(51) Int. Cl.

| | |
|---|---|
| ***B63C 9/00*** | (2006.01) |
| ***B63B 34/10*** | (2020.01) |
| ***B63B 79/10*** | (2020.01) |
| ***B63B 79/40*** | (2020.01) |
| ***B63H 21/17*** | (2006.01) |
| ***B63H 21/21*** | (2006.01) |

(52) U.S. Cl.

CPC ..... *B63C 9/0005* (2013.01); *B63B 34/10* (2020.02); *B63B 79/10* (2020.01); *B63B 79/40* (2020.01); *B63H 21/17* (2013.01); *B63H 21/21* (2013.01); *B63H 2021/216* (2013.01)

(58) Field of Classification Search

CPC ..... B63C 9/0005; B63B 79/40; B63B 79/10; B63B 34/10; B63H 21/17; B63H 21/21; B63H 2021/216

See application file for complete search history.

(56) References Cited

U.S. PATENT DOCUMENTS

| | | | | |
|---|---|---|---|---|
| 3,694,596 | A | 9/1972 | Carlson | |
| 6,612,881 | B2 | 9/2003 | Kanno | |
| 8,838,308 | B2 | 9/2014 | Meyers | |
| 9,486,382 | B1 | 11/2016 | Boss | |
| 10,029,567 | B2 | 7/2018 | Lefebvre et al. | |
| 2002/0045391 | A1* | 4/2002 | Kanno | F02D 17/04 440/88 F |
| 2011/0295454 | A1 | 12/2011 | Meyers | |
| 2022/0118969 | A1 | 4/2022 | Liu et al. | |
| 2024/0067321 | A1* | 2/2024 | Trotter | B63H 21/21 |

OTHER PUBLICATIONS

Snowmobile Safety and Certification Committee, SSCC/11 Supplement—Detailed Standards and Testing Specifications and Procedures, Jun. 10, 2020, Haslett, USA.

SAE International, Surface Vehicle Recommended Practice—Speed Control Assurance for Snowmobiles J1222, Aug. 2014, http://www.sae.org.

* cited by examiner

*Primary Examiner* — Michael D Lang

(74) *Attorney, Agent, or Firm* — Norton Rose Fulbright Canada LLP

(57) ABSTRACT

Methods and systems for operating powersport vehicles during an operator-vehicle separation condition are provided. One method includes detecting the operator-vehicle separation condition using a first tetherless criterion and a second tetherless criterion. In response to detecting the operator-vehicle separation condition using both the first tetherless criterion and the second tetherless criterion, the method includes preventing propulsion of the powersport vehicle.

20 Claims, 8 Drawing Sheets

TETHERLESS SHUTOFF SYSTEMS AND METHODS FOR POWERSPORT VEHICLES

CROSS-REFERENCE TO RELATED APPLICATION(S)

This application claims priority from U.S. Provisional Patent Application No. 63/219,117, filed Jul. 7, 2021, which is incorporated by reference in its entirety herein.

TECHNICAL FIELD

The disclosure relates generally to powersport vehicles, and more particularly to preventing propulsion of powersport vehicles during emergency conditions.

BACKGROUND

Powersport vehicles typically have an emergency shutoff system to interrupt the ignition system of an engine of the powersport vehicle in case of an emergency. Such emergency shutoff systems can be activated via an emergency shutoff switch (sometimes called a "kill switch") that is readily accessible to the operator, or via a tether switch. The tether switch is activated when a tether cord or lanyard that is attached to the vehicle and to the operator of the vehicle becomes detached from the vehicle in case of an operator-vehicle separation condition for example. The use of a tether cord that must be physically attached to the operator and to the vehicle can be inconvenient and cumbersome for the operator. Improvement is desirable.

SUMMARY

In one aspect, the disclosure describes a method of operating a powersport vehicle during an operator-vehicle separation condition. The method comprises:

detecting the operator-vehicle separation condition using:

a first tetherless criterion indicative of the operator-vehicle separation condition; and a second tetherless criterion indicative of the operator-vehicle separation condition, the second tetherless criterion being different from the first tetherless criterion; and in response to detecting the operator-vehicle separation condition using both the first tetherless criterion and the second tetherless criterion, preventing propulsion of the powersport vehicle.

The powersport vehicle may be an electric powersport vehicle including an electric motor for propelling the powersport vehicle. Preventing propulsion of the powersport vehicle may include preventing propulsion of the powersport vehicle via the electric motor.

The method may comprise: using first data acquired via a first sensor of a first type to detect the operator-vehicle separation condition using the first tetherless criterion; and using second data acquired via a second sensor of a second type to detect the operator-vehicle separation condition using the second tetherless criterion. The second type may be different from the first type.

Detecting the operator-vehicle separation condition may be based on an operating parameter of the powersport vehicle.

The operating parameter of the powersport vehicle may include a speed of the powersport vehicle.

The operating parameter of the powersport vehicle may include whether a first mode of operation of the powersport vehicle, or a second mode of operation of the powersport vehicle is active when the operator-vehicle separation condition is detected. The first mode of operation may require a manual accelerator command to be input manually by the operator. The second mode of operation may include an automatic accelerator command to be provided automatically.

The first tetherless criterion may include whether an absence of an operator's hand on a handgrip of the powersport vehicle exists.

The first tetherless criterion may include whether an absence of an operator's two hands on two respective handgrips of the powersport vehicle exists.

The second tetherless criterion may include whether a decrease in weight carried by the powersport vehicle exists.

The second tetherless criterion may include whether an absence of operator input to an accelerator of the powersport vehicle exists.

The second tetherless criterion may include whether the powersport vehicle has a non-upright orientation.

The first tetherless criterion or the second tetherless criterion may include whether a decrease in weight carried by the powersport vehicle exists.

The method may comprise inferring the decrease in weight carried by the powersport vehicle by detecting a decrease in power output of the electric motor of the powersport vehicle relative to the speed of the powersport vehicle.

The first tetherless criterion or the second tetherless criterion may include whether an absence of a portable electronic device (PED) proximal to the powersport vehicle exists.

The first tetherless criterion or the second tetherless criterion may include whether an absence of the operator from a location expected to be occupied by the operator on the powersport vehicle exists.

Preventing propulsion of the powersport vehicle may be conditioned upon the speed of the powersport vehicle being greater than a threshold speed.

Detecting the operator-vehicle separation condition using the first and second tetherless criteria may be performed when an operating parameter of the powersport vehicle has a first value. The method may include, when the operating parameter of the powersport vehicle has a second value different from the first value, detecting the operator-vehicle separation condition using: a third tetherless criterion indicative of the operator-vehicle separation condition; and a fourth tetherless criterion indicative of the operator-vehicle separation condition.

Embodiments may include combinations of the above features.

In another aspect, the disclosure describes a tetherless system for preventing propulsion of a powersport vehicle during an operator-vehicle separation condition. The tetherless system comprises:

a first sensor operative to sense a first tetherless characteristic indicative of the operator-vehicle separation condition;

a second sensor operative to sense a second tetherless characteristic indicative of the operator-vehicle separation condition, the second tetherless characteristic being different from the first tetherless characteristic;

one or more data processors operatively connected to the first and second sensors; and non-transitory machine-readable memory storing instructions executable by the one or more data processors and configured to cause the one or more data processors to:

detect the operator-vehicle separation condition using the sensed first and second tetherless characteristics; and in response to detecting the operator-vehicle separation condition, cause propulsion of the powersport vehicle to be prevented.

Causing propulsion of the powersport vehicle to be prevented may include causing propulsion of the powersport vehicle via an electric motor to be prevented.

Detecting the operator-vehicle separation condition may be based on an operating parameter of the powersport vehicle.

The operating parameter of the powersport vehicle may include a speed of the powersport vehicle.

The operating parameter of the powersport vehicle may include whether a first mode of operation of the powersport vehicle, or a second mode of operation of the powersport vehicle is active when the operator-vehicle separation condition is detected. The first mode of operation may require a manual accelerator command to be input manually by the operator. The second mode of operation may include an automatic accelerator command to be provided automatically.

The first tetherless characteristic may include an absence of an operator's hand on a handgrip of the powersport vehicle.

The first tetherless characteristic may include an absence of an operator's two hands on two respective handgrips of the powersport vehicle.

The first sensor may be integrated with the handgrip and may include any one of the following: a capacitive sensor, a resistive sensor, an ultrasonic sensor and an optical sensor.

The second tetherless characteristic may include a decrease in weight carried by the powersport vehicle.

The second tetherless characteristic may include an absence of operator input to an accelerator of the powersport vehicle.

The second tetherless characteristic may include whether the powersport vehicle has a non-upright orientation.

The first tetherless characteristic or the second tetherless characteristic may include a decrease in weight carried by the powersport vehicle.

The decrease in weight carried by the powersport vehicle may be inferred from a decrease in power output of an or the electric motor of the powersport vehicle relative to the speed of the powersport vehicle.

The first tetherless characteristic or the second tetherless characteristic may include an absence of operator input to an accelerator of the powersport vehicle.

The first tetherless characteristic or the second tetherless characteristic may include an orientation of the powersport vehicle.

Causing propulsion of the powersport vehicle to be prevented may be conditioned upon the speed of the powersport vehicle being greater than a threshold speed.

The tetherless system may comprise: a third sensor operative to sense a third tetherless characteristic indicative of the operator-vehicle separation condition; and a fourth sensor operative to sense a fourth tetherless characteristic indicative of the operator-vehicle separation condition. The instructions may be configured to cause the one or more data processors to: when an operating parameter of the powersport vehicle has a first value, detect the operator-vehicle separation condition using the sensed first and second tetherless characteristics; and when the operating parameter of the powersport vehicle has a second value different from the first value, detect the operator-vehicle separation condition using the sensed third and fourth tetherless characteristics.

Embodiments may include combinations of the above features.

In another aspect, the disclosure describes a method of operating a powersport vehicle during an operator-vehicle separation condition. The method comprises:

when an operating parameter of the powersport vehicle has a first value, detecting the operator-vehicle separation condition using a first tetherless criterion indicative of the operator-vehicle separation condition;

when the operating parameter of the powersport vehicle has a second value different from the first value, detecting the operator-vehicle separation condition using a second tetherless criterion indicative of the operator-vehicle separation condition, the second tetherless criterion being different from the first tetherless criterion; and in response to detecting the operator-vehicle separation condition using the first tetherless criterion or the second tetherless criterion, preventing propulsion of the powersport vehicle.

The operating parameter of the powersport vehicle may include a speed of the powersport vehicle.

When the speed of the powersport vehicle has the first value, the first criterion may include whether an absence of an operator's hand on a handgrip of the powersport vehicle exists.

When the speed of the powersport vehicle has the first value, the first criterion may include whether an absence of operator input to an accelerator of the powersport vehicle exists.

When the speed of the powersport vehicle has the second value and the second value is higher than the first value, the second criterion may include whether the powersport vehicle has a non-upright orientation.

When the speed of the powersport vehicle has the second value and the second value is higher than the first value, the second criterion may include an output power of an electric motor propelling the powersport vehicle.

The first value of the operating parameter of the powersport vehicle may be indicative of a first mode of operation of the powersport vehicle. The first mode of operation may require a manual accelerator command to be input manually by the operator. The second value of the operating parameter of the powersport vehicle may be indicative of a second mode of operation of the powersport vehicle. The second mode of operation may include an automatic accelerator command to be provided automatically.

Embodiments may include combinations of the above features.

In another aspect, the disclosure describes a tetherless system for operating a powersport vehicle during an operator-vehicle separation condition. The system may comprise:

a first sensor operative to sense a first tetherless characteristic indicative of the operator-vehicle separation condition;

a second sensor operative to sense a second tetherless characteristic indicative of the operator-vehicle separation condition, the second tetherless characteristic being different from the first tetherless characteristic;

one or more data processors operatively connected to the first and second sensors; and non-transitory machine-readable memory storing instructions executable by the one or more data processors and configured to cause the one or more data processors to:

when an operating parameter of the powersport vehicle has a first value, detect the operator-vehicle separation condition using the sensed first tetherless characteristic;

when the operating parameter of the powersport vehicle has second value different from the first value, detect the operator-vehicle separation condition using the sensed second tetherless characteristic; and in response to detecting the operator-vehicle separation condition using the first tetherless characteristic or the second tetherless characteristic, cause propulsion of the powersport vehicle to be prevented.

The operating parameter of the powersport vehicle may include a speed of the powersport vehicle.

When the speed of the powersport vehicle has the first value, the first tetherless characteristic may include an absence of an operator's hand on a handgrip of the powersport vehicle.

When the speed of the powersport vehicle has the first value, the first tetherless characteristic may include an absence of operator input to an accelerator of the powersport vehicle.

When the speed of the powersport vehicle has the second value and the second value is higher than the first value, the second tetherless characteristic may include an orientation of the powersport vehicle.

When the speed of the powersport vehicle has the second value and the second value is higher than the first value, the second tetherless characteristic may be indicative of an output power of an electric motor propelling the powersport vehicle.

The first value of the operating parameter of the powersport vehicle may be indicative of a first mode of operation of the powersport vehicle. The first mode of operation may require a manual accelerator command to be input manually by the operator. The second value of the operating parameter of the powersport vehicle may be indicative of a second mode of operation of the powersport vehicle. The second mode of operation may include an automatic accelerator command to be provided automatically.

Embodiments may include combinations of the above features.

In another aspect, the disclosure describes a method of operating a powersport vehicle when an operator's ability to safely operate the powersport vehicle is compromised. The method comprises:

detecting one or more of the following conditions:

an absence of the operator's hand on a handgrip of the powersport vehicle;

the powersport vehicle having a non-upright orientation;

a decrease in weight carried by the powersport vehicle; and an absence of the operator from a location expected to be occupied by the operator on the powersport vehicle; and in response to detecting the one or more conditions, preventing propulsion of the powersport vehicle.

The one or more conditions may include the absence of the operator's hand on the handgrip of the powersport vehicle.

The one or more conditions may include an absence of the operator's two hands on two respective handgrips of the powersport vehicle.

The one or more conditions may include the powersport vehicle having the non-upright orientation.

The one or more conditions may include the decrease in weight carried by the powersport vehicle.

The one or more conditions may include the absence of the operator from the location expected to be occupied by the operator on the powersport vehicle.

Preventing propulsion of the powersport vehicle may be conditioned upon the speed of the powersport vehicle being greater than a threshold speed.

Detecting the one or more conditions may be conditioned upon the speed of the powersport vehicle being greater than a threshold speed.

Preventing propulsion of the powersport vehicle may be conditioned upon the powersport vehicle being propelled when the one or more conditions are detected.

The one or more conditions may each include a persistence criterion.

Embodiments may include combinations of the above features.

In another aspect, the disclosure describes a system for preventing propulsion of a powersport vehicle when an operator's ability to safely operate the powersport vehicle is compromised. The system comprises:

one or more sensors operative to detect one or more of the following conditions:

an absence of the operator's hand on a handgrip of the powersport vehicle;

the powersport vehicle having a non-upright orientation;

a decrease in weight carried by the powersport vehicle; and an absence of the operator from a location expected to be occupied by the operator on the powersport vehicle;

one or more data processors operatively connected to the one or more sensors; and non-transitory machine-readable memory storing instructions executable by the one or more data processors and configured to cause the one or more data processors to, in response to detecting the one or more conditions, cause propulsion of the powersport vehicle to be prevented.

The one or more conditions may include the absence of the operator's hand on the handgrip of the powersport vehicle.

The one or more conditions may include an absence of the operator's two hands on two respective handgrips of the powersport vehicle.

The one or more conditions may include the powersport vehicle having the non-upright orientation.

The one or more conditions may include the decrease in weight carried by the powersport vehicle.

The one or more conditions may include the absence of the operator from the location expected to be occupied by the operator on the powersport vehicle.

The instructions may be configured to cause the one or more data processors to prevent propulsion of the powersport vehicle conditioned upon a speed of the powersport vehicle being greater than a threshold speed.

The instructions may be configured to cause the one or more data processors to prevent propulsion of the powersport vehicle conditioned upon the powersport vehicle being propelled when the one or more conditions are detected.

The instructions may be configured to cause the one or more data processors to prevent propulsion of the powersport vehicle conditioned upon the one or more conditions each including a persistence criterion.

Embodiments may include combinations of the above features.

In another aspect, the disclosure describes a powersport vehicle comprising a system as disclosed herein.

In another aspect, the disclosure describes an electric powersport vehicle comprising a system as disclosed herein.

In another aspect, the disclosure describes a computer program product for operating a powersport vehicle, the computer program product comprising a non-transitory computer readable storage medium having program code embodied therewith, the program code readable/executable by a computer, processor or logic circuit to perform a method as disclosed herein.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure relates to systems and associated methods for preventing (e.g., interrupting) propulsion of (e.g., electric) powersport vehicles when an operator-vehicle separation condition is detected in a tetherless manner (i.e., without the use of a tether cord physically attached to the vehicle and to the operator of the vehicle). In some embodiments, the systems and methods described herein may be particularly suitable for powersport vehicles such as snowmobiles, motorcycles, personal watercraft (PWCs), all-terrain vehicles (ATVs), and (e.g., side-by-side) utility task vehicles (UTVs). In some embodiments, the systems and methods described herein may be suitable for use on electric powersport vehicles, powersport vehicles propelled by internal combustion engines, or hybrid powersport vehicles.

In some embodiments, the systems and methods described herein may prevent a powersport vehicle from being propelled when an emergency situation, such as an operator-vehicle separation condition has been detected during which an operator's ability to safely operate the powersport vehicle is compromised. Such systems and methods may use one, two or more tetherless criteria to determine whether an operator-vehicle separation condition exists. Such systems and methods may use different tetherless criteria to determine whether an operator-vehicle separation condition exists during different operating conditions of the vehicle. The use of the tetherless systems and methods described herein may be less inconvenient and cumbersome to the operator of the powerport vehicle compared to the use of physical tether cords required to operate existing powersport vehicles. In some embodiments, the use of more than one criterion to detect the operator-vehicle separation condition may promote valid detections and reduce the likelihood of nuisance detections (i.e., false-positives).

The terms "connected" and "coupled to" may include both direct connection and coupling (where two elements contact each other) and indirect connection and coupling (where at least one additional element is located between the two elements).

The term "substantially" as used herein may be applied to modify any quantitative representation which could permissibly vary without resulting in a change in the function to which it is related.

Aspects of various embodiments are described through reference to the drawings.

Figure 1:
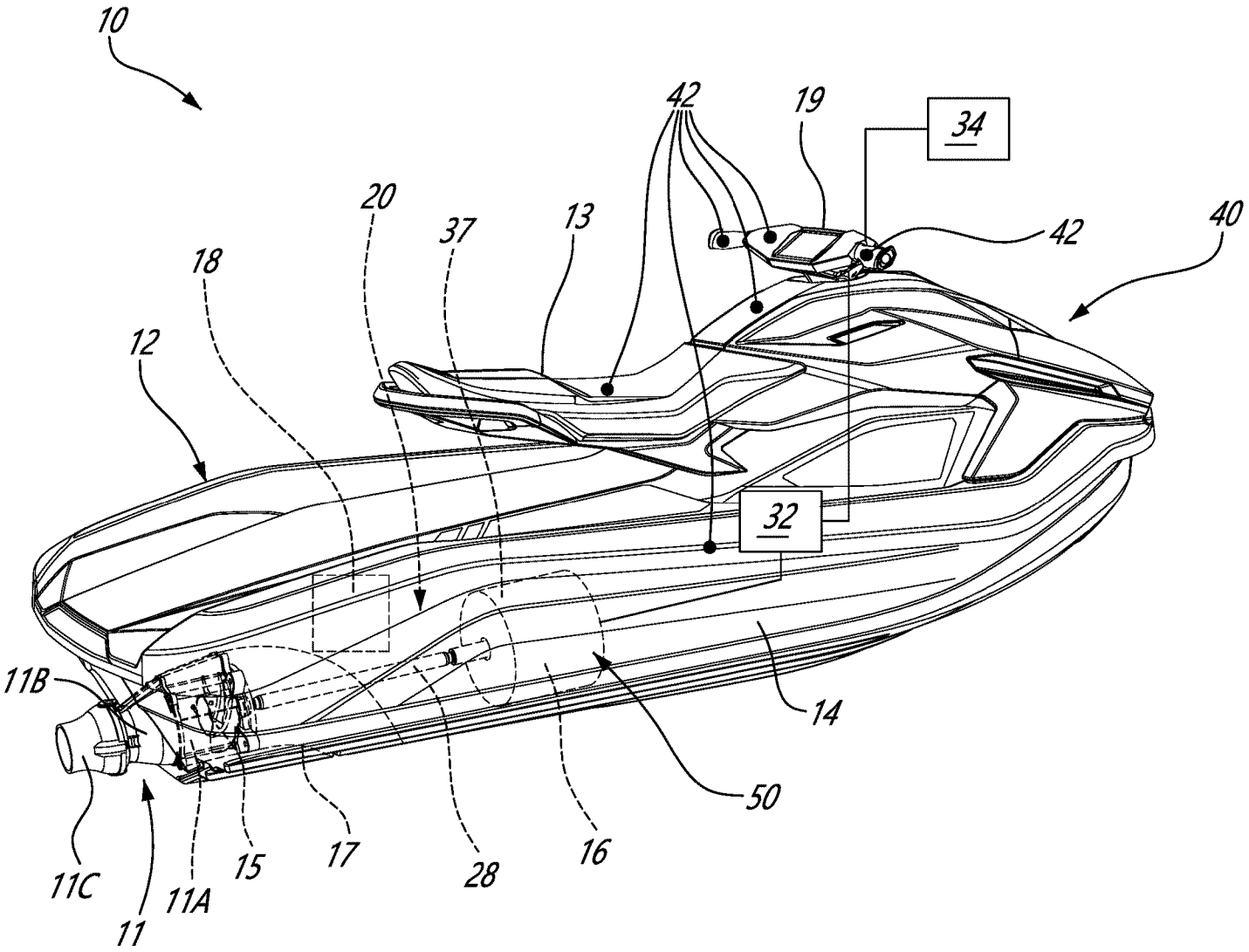
FIG. 1 is a perspective schematic representation of an exemplary powersport vehicle including a tetherless emergency shutoff system as described herein.

FIG. 1 illustrates powersport vehicle 10 (referred hereinafter as "vehicle 10") of a type for transporting an operator and one or more passengers over a body of water. Vehicle 10 is illustrated herein as a personal watercraft but it is understood that aspects of this disclosure are applicable to other types of powersport vehicles. Vehicle 10 may be electrically propelled, or propelled by an internal combustion engine. An upper portion of vehicle 10 may include a deck 12 and a straddle seat 13 for accommodating an operator (driver) of vehicle 10 and optionally one or more passengers. A lower portion of vehicle 10 may include a hull 14 which may be partially submerged in the water during use. Hull 14 and deck 12 may enclose an interior volume 37 of vehicle 10 which may provide buoyancy to vehicle 10, and may house components of vehicle 10. A non-limiting list of components of vehicle 10 that may be located in interior volume 37 include one or more electric motors 16 (referred hereinafter in the singular as "motor 16"), one or more electric batteries 18 (referred hereinafter in the singular), a thermal management system, and other components of an electric powertrain 50 of vehicle 10.

Vehicle 10 may include a jet propulsion system 11 to create a jet of water which provides thrust to propel vehicle 10 through the water. The jet propulsion system 11 may include a jet pump 11A including an impeller 15 disposed in the water to draw water through a water intake 17 on an underside of hull 14, with the water being directed to jet pump 11A. Water ejected from jet pump 11A may be directed through a venturi 11B which may further accelerate the water jet to provide thrust. The accelerated water jet may be ejected from venturi 11B via a pivotable steering nozzle 11C which may be directionally controlled by the operator via handlebar 19 to provide a directionally controlled jet of water to propel and steer vehicle 10. In some embodiments, a pivotable bowl-shaped bucket (not shown) may be positioned downstream of the pivoting steering nozzle 11C and operable to vary the direction of the water jet. The bucket may be pivotable, for instance via a rod (not shown), in response to the operator selecting various operating modes such as a forward mode (in which the water is directed in a forward direction), a reverse mode (in which the water is directed in a forward direction), or a neutral mode (in which water is directed in a downward direction). The vehicle 10 may additionally be equipped with a braking system where, upon actuation of a brake lever, the bucket may oriented to direct water in a downward and/or forward direction to slow forward movement of vehicle 10 for example.

The electric powertrain 50 of vehicle 10 may include motor 16 drivingly coupled to impeller 15 via a drive shaft 28 for propelling vehicle 10. The electric powertrain 50 may also include battery 18 for providing electric power to drive motor 16. The operation of motor 16 and the delivery of drive current to motor 16 may be controlled by a controller 32 based on an operator's actuation of an accelerator 34, sometimes referred to as a "throttle", disposed on handlebar 19. In some embodiments, battery 18 may be a lithium ion or other type of battery 18. In various embodiments, motor 16 may be a permanent magnet synchronous motor or a brushless direct current motor for example.

The vehicle 10 may include the tetherless emergency shutoff system 40 (referred hereinafter as "system 40") described further below for detecting an operator-vehicle separation condition and controlling one or more aspects of vehicle 10 in response to such detection. The system 40 may include one or more operator state sensors 42 operative to sense respective tetherless characteristics indicative of the operator-vehicle separation condition, and/or whether the operator's ability to operate the vehicle is compromised. The operator state sensors 42 may be operatively coupled to controller 32 so that characteristics sensed by operator state sensors 42 may be communicated to controller 32 and used by controller 32 to determine (e.g., validate, confirm) the operator-vehicle separation condition and control one or more aspects of vehicle 10 in response to such detection. As explained below, operator state sensors 42 may all be of a same type, or operator state sensors 42 may include sensors of different types configured to sense different characteristics.

Figure 2:
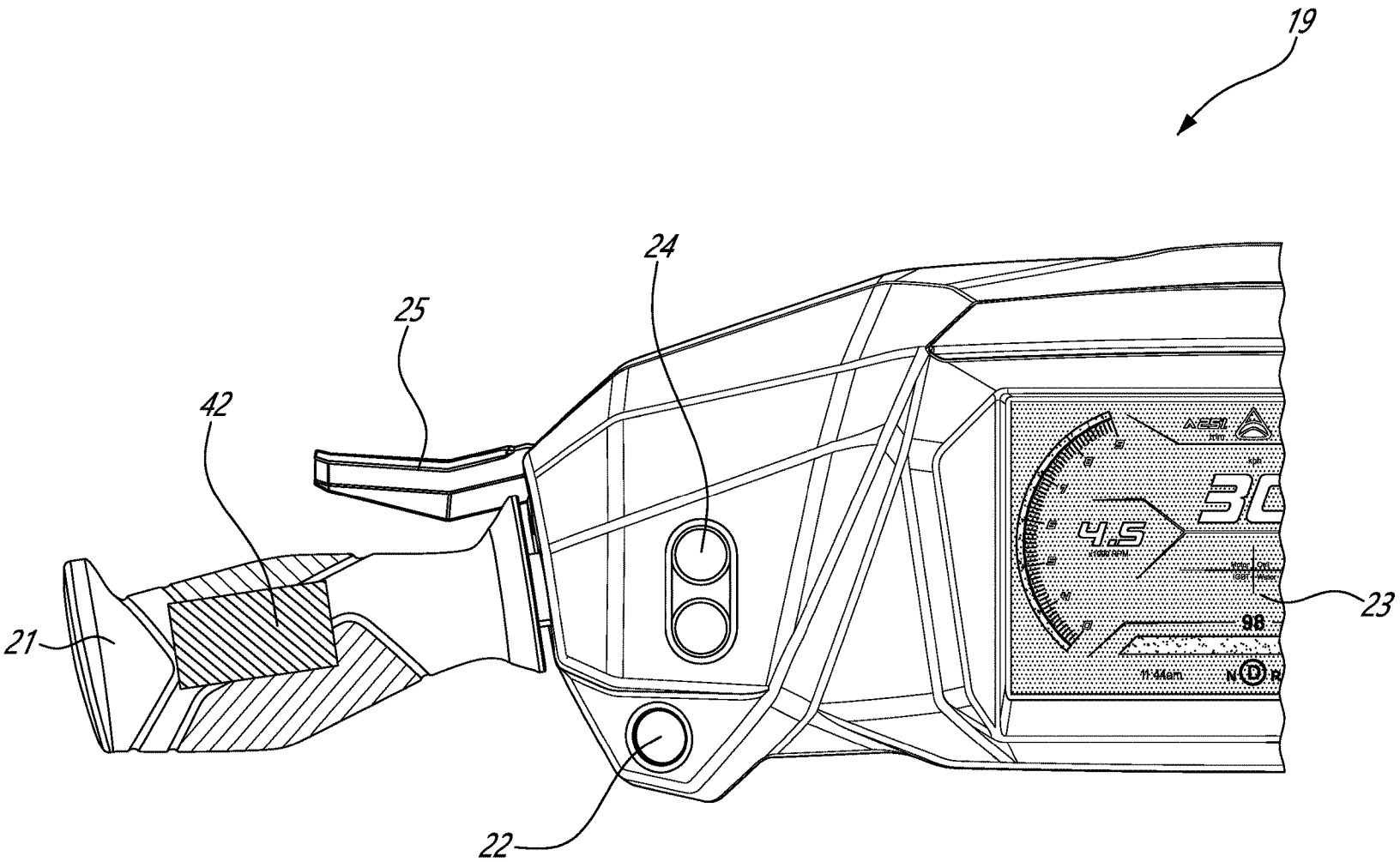
FIG. 2 is a top view of part of an exemplary handlebar of the powersport vehicle of FIG. 1.

FIG. 2 shows part of an exemplary handlebar 19 of vehicle 10. The handlebar 19 may include a pair of (i.e., left and right) handgrips 21 (only the left handgrip 21 being shown) for respectively receiving thereon the left and right hands of the operator. A start/stop button 22 may be provided for powering and turning off vehicle 10. In some embodiments, start/stop button 22 may also function as an emergency shutoff (i.e., "kill") switch when vehicle 10 is operated. Alternatively, a separate emergency shutoff (i.e., "kill") switch may be provided.

The vehicle 10 may include an instrument panel 23 provided on a display screen disposed between left and right handgrips 21. The instrument panel 23 may provide the operator with information such as vehicle speed, remaining battery charge, other operating parameters and/or pertinent information. Depending on the type of vehicle 10, the speed of vehicle 10 may be derived from an operating speed of motor 16 or other component of powertrain 50, obtained via a suitable sensor(s) such as a tachometer or rotary encoder for example. In case of a PWC, the speed of vehicle 10 may be determined using a pitot tube submerged in the water. Alternatively or in addition, the speed of vehicle 10 may be determined using a satellite navigation device such as a global positioning system (GPS) receiver operatively connected to controller 32.

The vehicle 10 may include button 24 to control the operating mode (e.g. eco, normal, sport) or direction of travel of vehicle 10 (e.g., forward, reverse, neutral). Vehicle 10 may include brake lever 25 to control an optional (friction and/or regenerative) braking system of vehicle 10. The accelerator 34 (shown in FIG. 3) may be positioned adjacent the right handgrip or at another suitable location. The vehicle 10 may also include a button (not shown) to control the trim of the pivoting steering nozzle 110.

One or more operator state sensors 42 may be disposed on, integrated into or otherwise associated with one or both handgrips 21. Such operator state sensor(s) 42 may be operative to sense whether one or both of the operator's hands are disposed on one or both respective handgrips 21. The absence of the operator's hands on handgrips 21 may be indicative of the operator-vehicle separation condition. In some embodiments, a persistence criterion (i.e. minimum time threshold) may be associated with the absence of the operator's hands on the handgrips 21.

Figure 3:
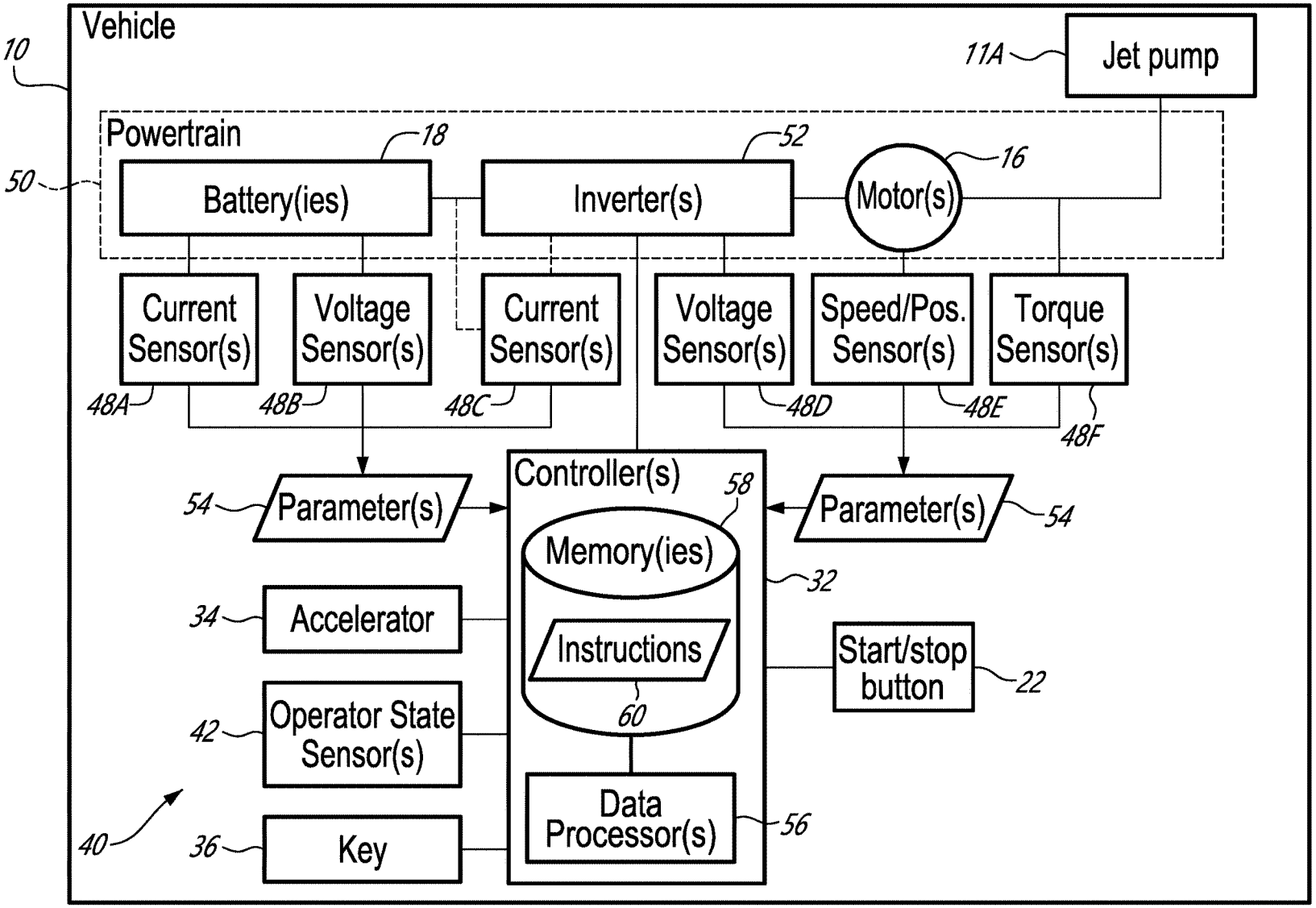
FIG. 3 is a schematic representation of the powersport vehicle including the tetherless emergency shutoff system.

FIG. 3 is a schematic representation of vehicle 10 including system 40. Vehicle 10 may include one or more parameter sensors 48A-48F operatively connected to component(s) of powertrain 50 of electric vehicle 10 and also to controller 32. Powertrain 50 may include one or more power inverters 52 (referred hereinafter in the singular) operatively connected between battery 18 and motor 16. Motor 16 may be drivingly coupled to jet pump 11A in case of vehicle 10 being a PWC. In case of other types of powersport vehicles, motor 16 may be drivingly connected to one or more ground-engaging members such as track of a snowmobile, or one or more wheels of a wheeled vehicle such as an ATV or UTV.

Parameter sensor(s) 48A-48F may be configured to sense one or more operating parameters 54 of vehicle 10 for use by controller 32 for regulating the operation of motor 16 and/or controlling other aspects of vehicle 10. In some embodiments, parameter(s) 54 may include data indicative of an amount of electric power being supplied to motor 16. For example, parameter(s) 54 may be acquired via one or more current sensors 48A, 48C and/or one or more voltage sensors 48B, 48D operatively connected to powertrain 50 and controller 32. Current sensor 48C may be operatively disposed between battery 18 and inverter 52 to measure DC current values representative of the real power supplied to motor 16.

In some embodiments, parameter(s) 54 may include data indicative of an operating speed and/or angular position of a rotor of motor 16. The operating speed of motor 16 may be acquired via speed/position sensor(s) 48E operatively connected to motor 16 and controller 32. Speed/position sensor(s) 48E may include any suitable instrument such as a rotary encoder and/or tachometer suitable for measuring the angular position of a rotor of motor 16 and/or the rotation speed (e.g., revolutions per minute) of the rotor of motor 16 and/or of drive shaft 28 (shown in FIG. 1).

In some embodiments, parameter(s) 54 of powertrain 50 may include data indicative of an output torque of motor 16. The output torque of motor 16 may be measured directly via torque sensor 48F or may be inferred based on the amount of electric power being supplied to motor 16 for example. In some embodiments, torque sensor 48F may include a rotary (i.e., dynamic) torque transducer suitable for measuring torque on a rotating shaft.

In some embodiments, vehicle 10 may include an operator key 36 permitting the operation of vehicle 10 when key 36 is received into a receptacle of vehicle 10, or when key 36 is in sufficient proximity to vehicle 10 for example. The engagement of key 36 with the receptacle or the proximity of key 36 to vehicle 10 may be communicated to controller 32 so that controller 32 may authorize the operation of vehicle 10.

Parameter(s) 54 may be indicative of a state and/or mode of operation of vehicle 10. For example, parameter(s) 54 may be indicative of whether vehicle 10 is in a "cruise control" mode of operation where accelerator commands are provided automatically to permit controller 32 to maintain a desired speed of vehicle 10 until the operator interferes with such mode of operation by applying a brake or otherwise interacting with a user interface of vehicle 10.

Controller 32 may include one or more data processors 56 (referred hereinafter as "processor 56") and non-transitory machine-readable memory 58. Controller 32 may be configured to regulate the operation of motor 16 via inverter 52, and optionally also control other aspects of operation of vehicle 10. Controller 32 may be operatively connected to parameter sensor(s) 48A-48F via wired or wireless connections for example so that one or more parameters 54 acquired via parameter sensor(s) 48A-48F may be received at controller 32 and used by processor 56 in one or more procedures or steps defined by instructions 60 stored in memory 58 and executable by processor 56. One or more operator state sensors 42 may be operatively connected to controller 32 for acquiring data indicative of the operator-vehicle separation condition and allowing controller 32 to validate the operator-vehicle separation condition and respond accordingly.

Controller 32 may carry out additional functions than those described herein. Processor 56 may include any suitable device(s) configured to cause a series of steps to be performed by controller 32 so as to implement a computer-implemented process such that instructions 60, when executed by controller 32 or other programmable apparatus, may cause the functions/acts specified in the methods described herein to be executed. Processor 56 may include, for example, any type of general-purpose microprocessor or microcontroller, a digital signal processing (DSP) processor, an integrated circuit, a field programmable gate array (FPGA), a reconfigurable processor, other suitably programmed or programmable logic circuits, or any combination thereof.

Memory 58 may include any suitable machine-readable storage medium. Memory 58 may include non-transitory computer readable storage medium such as, for example, but not limited to, an electronic, magnetic, optical, electromagnetic, infrared, or semiconductor system, apparatus, or device, or any suitable combination of the foregoing. Memory 58 may include a suitable combination of any type of machine-readable memory that is located either internally or externally to controller 32. Memory 58 may include any storage means (e.g. devices) suitable for retrievably storing machine-readable instructions 60 executable by processor 56.

Various aspects of the present disclosure may be embodied as systems, devices, methods and/or computer program products. Accordingly, aspects of the present disclosure may take the form of an entirely hardware embodiment, an entirely software embodiment or an embodiment combining software and hardware aspects. Furthermore, aspects of the present disclosure may take the form of a computer program product embodied in one or more non-transitory computer readable medium(ia) (e.g., memory 58) having computer readable program code (e.g., instructions 60) embodied thereon. Computer program code for carrying out operations for aspects of the present disclosure in accordance with instructions 60 may be written in any combination of one or more programming languages. Such program code may be executed entirely or in part by controller 32 or other data processing device(s). It is understood that, based on the present disclosure, one skilled in the relevant arts could readily write computer program code for implementing the methods described and illustrated herein.

Figure 4:
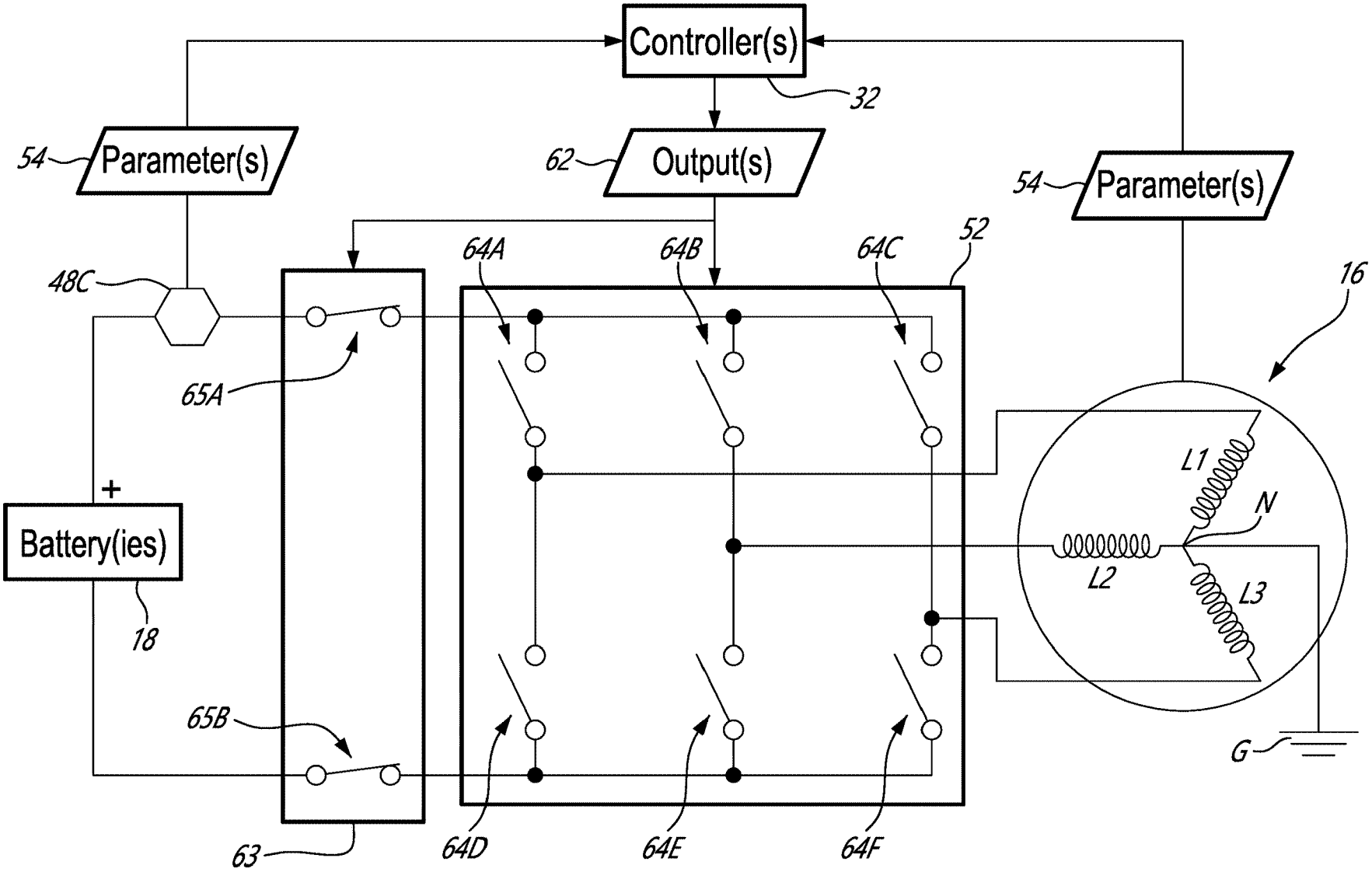
FIG. 4 is a schematic representation of an exemplary power inverter operatively connected between a battery and an electric motor of the powersport vehicle.

FIG. 4 is an exemplary schematic representation of power inverter 52 operatively connected between battery 18 and motor 16 of vehicle 10. Controller 32 may generate output(s) 62 for controlling the operation of motor 16 via inverter 52. For example, based on a sensed position of accelerator 34 (shown in FIG. 1) and parameter(s) 54 received as feedback, controller 32 may generate output(s) 62 for controlling the delivery of electric power from battery 18 to motor 16 according to instructions 60. The delivery of electric power to motor 16 may be performed by controlling the operation of inverter 52 or other suitable power electronics module operatively disposed between battery 18 and motor 16. Inverter 52 may include suitable electronic switches 64A-64F, such as insulated gate bipolar transistors (IGBTs) for example, to provide motor 16 with electric power having the desired characteristics to implement the desired performance of vehicle 10 based on the input(s) and feedback received at controller 32.

Main contactor 63 may be operatively disposed between battery 18 and inverter 52. Main contactor 63 may includes switches 65A, 65B that may be closed or opened to electrically connect battery 18 to inverter 52 in preparation for the delivery of electric power to motor 16, or to electrically disconnect battery 18 from inverter 52. Main contactor 63 may be controlled by output 62 of controller 32. Switches 65A, 65B are shown in a closed state in FIG. 4. Opening one or both switches 65A, 65B of main contactor 63 may prevent electric power from being supplied to motor 16.

Motor 16 may be a polyphase (e.g., 3-phase) synchronous motor and may include a plurality of armature (e.g., stator) windings such as armature windings L1, L2, L3 shown schematically in FIG. 4 as an example. Armature windings L1, L2, L3 may be connected in a wye or delta configuration. Neutral point N may be connected to ground G.

Upon detection of the operator-vehicle separation condition, controller 32 may cause propulsion of vehicle 10 via motor 16 to be prevented. In some embodiments, the prevention may include opening one or both switches 65A, 65B. In some embodiments, the prevention may include ignoring one or more accelerator commands received via accelerator 34. In some embodiments, the prevention may include commanding inverter 52 to adopt a state where motor 16 is not propelling vehicle 10. In some embodiments, the prevention may include commanding inverter 52 to cause motor 16 to have a substantially no-load (e.g., zero-torque) operating state. The no-load operating state may correspond to substantially no torque being output from motor 16, or being input into motor 16 operating as a generator. In some embodiments, the prevention may include commanding inverter 52 to cause motor 16 to undergo electrical (e.g., dynamic) braking where motor 16 is used as a generator when vehicle 10 is in motion. Braking of motor 16 may include rheostatic braking where the generated electric power is dissipated as heat in resistors external to motor 16. Braking of motor 16 may include regenerative braking where the generated electric power is returned to the supply line for charging battery 18.

Figure 5:
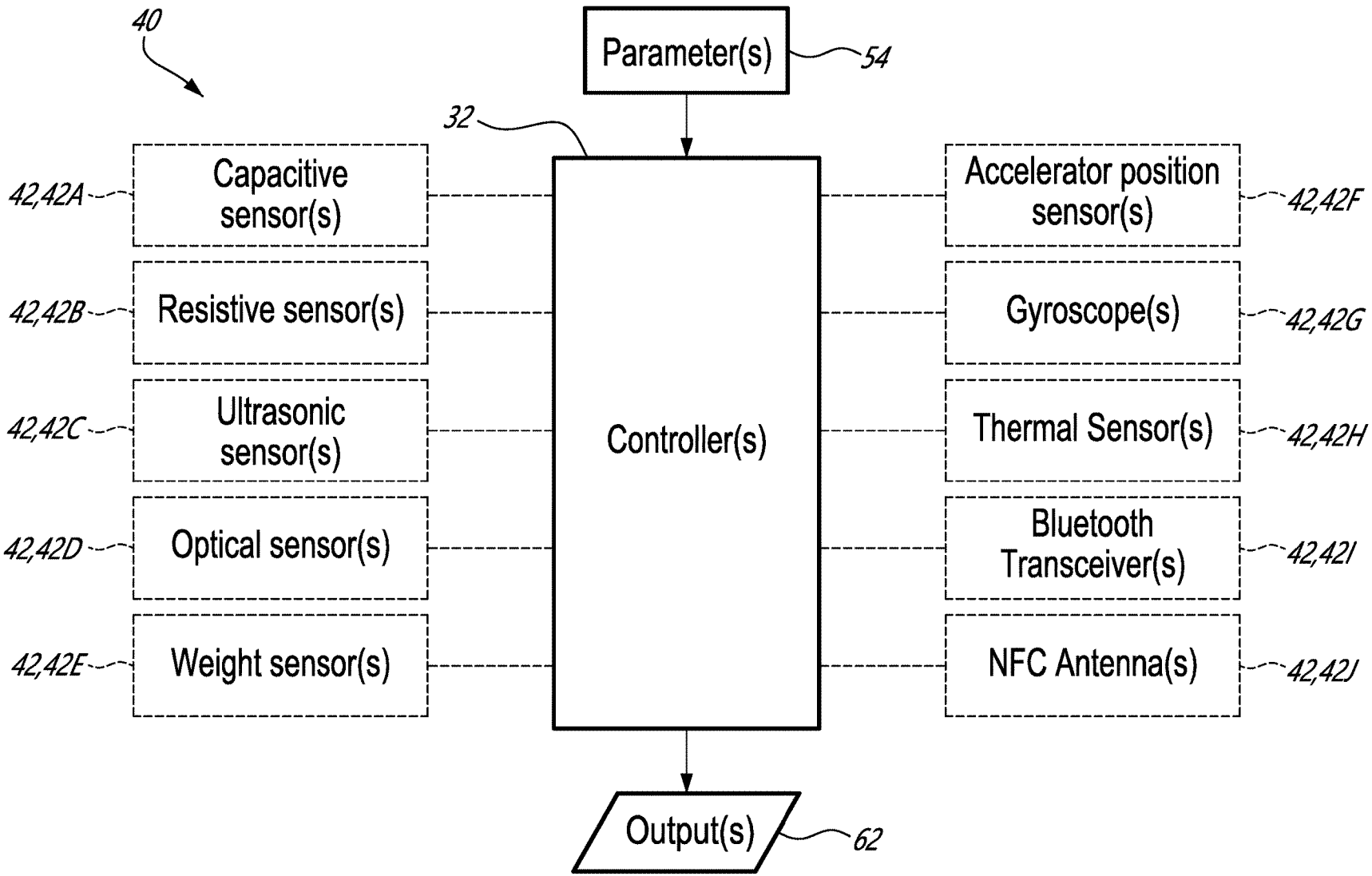
FIG. 5 is a schematic representation of the controller of FIG. 3 in communication with various sensors of the tetherless emergency shutoff system.

FIG. 5 is a schematic representation of controller 32 of FIG. 3 operatively connected to a plurality of different types of exemplary operator state sensors 42 (also shown in FIG. 1) that may be used to determine, in a tetherless manner, whether an operator-vehicle separation condition exists. In some embodiments, one or more parameter sensors 48A-48F may, instead or in addition, be used to determine, in a tetherless manner, whether the operator-vehicle separation condition exists. In some embodiments, data from one or more operator state sensors 42 may be used in conjunction with one or more tetherless criteria to determine whether the operator-vehicle separation condition exists. In some embodiments where a plurality of operator state sensors 42 are used in the determination, data acquired via two or more different operator state sensors 42 may be used with different respective tetherless criteria that are indicative of the operator-vehicle separation condition. The use of multiple operator state sensors 42 and respective tetherless criteria may provide independent determinations of the operator-vehicle separation condition to promote a reliable determination and reduce the likelihood of false positives.

The tetherless criteria described herein and the tetherless characteristics sensed by operator state sensor(s) 42 are unassociated with a physical tether cord and their use may reduce or eliminate the need for a physical tether cord to be used with vehicle 10. In some embodiments, determining that the operator-vehicle separation condition exists may rely on data acquired via any one of operator state sensors 42. In some embodiments, determining that the operator-vehicle separation condition exists may rely on data acquired via any combination of two or more operator state sensors 42. It is understood that one or more operator state sensors 42 of other types than those recited herein may also be suitable.

In some embodiments, one or more operator state sensors 42 may be incorporated into one or both handgrips 21 to detect the absence or presence of the operator's hand(s) on or proximal to the respective handgrip(s) 21. Data acquired from such operator state sensor(s) 42 may be communicated to controller 32 and used by controller 32 in a tetherless criterion. The tetherless criterion may include whether or not the operator's hand is absent from the associated handgrip(s) 21. In some embodiments, one or more proximity sensors may be suitable and integrated into one or more handgrips 21. Examples of suitable operator state sensors 42 for sensing the presence and/or absence of the operator's hand(s) on handgrip(s) 21 include, a capacitive (e.g., touch) sensor 42A, a resistive sensor 42B, an ultrasonic sensor 42C, an optical sensor 42D (e.g., camera), and a thermal (e.g., infrared) sensor 42H.

The absence of the operator's hand(s) on handgrip(s) 21 (e.g., lack of contact between the hand(s) and handgrip(s) 21) may be used in combination with one or more other tetherless criteria described herein and/or with one or more operating parameters 54 of vehicle 10. In some embodiments, the absence of the operator's hand(s) on handgrip(s) 21 as a tetherless criterion may be active only in certain operating conditions such as when the speed of vehicle 10 is greater than a speed threshold for example. The use of such speed threshold may permit an operator to stand next to vehicle 10 (e.g., in case of vehicle 10 being a snowmobile, ATV or UTV) without necessarily having their hand(s) on handgrip(s) 21, actuate accelerator 34, and cause vehicle 10 to be propelled at a relatively slow speed over an obstacle and/or cause vehicle 10 to be propelled to become unstuck from deep snow, or loaded into a trailer or truck bed for example.

In some embodiments, the absence of the operator's hand(s) on handgrip(s) 21 as a tetherless criterion may include a persistence criterion where the sensed characteristic must be met for a minimum threshold time (e.g., one or more seconds) before the operator-vehicle separation condition may be detected. The persistence criterion may be selected to reduce the risk of false positives caused by momentary removals of the operator's hand(s) from handgrip(s) 21 during normal operation of vehicle 10.

Additionally or alternatively, the operator-vehicle separation condition may be detected in a tetherless manner by sensing a decrease or absence in weight carried by vehicle 10 using weight sensor 42E for example. Weight sensor 42E may include a suitable force transducer that converts a load into an electric signal. In some embodiments, weight sensor 42E may include a load cell incorporated into seat 13 or a suspension component of vehicle 10 for example. In some embodiments, weight sensor 42E may include a strain gauge coupled to a structural component of seat 13 or to a suspension component of vehicle 10 for example. In some embodiments, weight sensor 42E may be operatively disposed to sense a load on footrests of vehicle 10, or sense a load on hull 14 or other structural component of vehicle 10. Data acquired from such weight sensor 42E may be communicated to controller 32 and used by controller 32 in a tetherless criterion. The tetherless criterion may include whether or not a decrease in weight carried by vehicle 10 indicative of the operator-vehicle separation (and/or passenger-vehicle separation) has occurred.

The reduction in weight carried by vehicle 10 may be used in combination with one or more other tetherless criteria described herein and/or with one or more operating parameters 54 of vehicle 10. In some embodiments, the reduction in weight carried by vehicle 10 as a tetherless criterion may be active only in certain operating conditions such as when the speed of vehicle 10 is greater than a speed threshold for example. In a similar manner as the absence of the operator's hand(s) on handgrip(s) 21, the use of such speed threshold may still permit an operator to stand next to vehicle 10 (e.g., in case of vehicle 10 being a snowmobile, ATV or UTV) without necessarily being onboard vehicle 10, actuate accelerator 34, and cause vehicle 10 to be propelled at a relatively slow speed over an obstacle and/or cause vehicle 10 to be propelled to become unstuck from deep snow, or loaded into a trailer or truck bed example.

In some embodiments, the reduction in weight carried by vehicle 10 as a tetherless criterion may include a persistence criterion where the sensed characteristic must be met for a minimum threshold time (e.g., one or more seconds) before the operator-vehicle separation condition may be detected. The persistence criterion may be selected to reduce the risk of false positives caused by momentary removals/reductions of the operator's weight from vehicle 10 that could occur during normal operation of vehicle 10.

In some embodiments, a decrease in weight carried by vehicle 10 indicative of the operator-vehicle separation may be inferred (e.g., detected indirectly). For instance, controller 32 may monitor an output power (or other parameter 54 indicative thereof) of motor 16 and a speed of vehicle 10 so that a power-to-speed ratio may be calculated. As such, a decrease in power-to-speed ratio may be indicative of a reduction in weight carried by vehicle 10, which may consequently be indicative of the operator-vehicle separation (and/or passenger-vehicle separation).

In some embodiments, the inference of the reduction in weight carried by vehicle 10 may be used in combination with one or more other tetherless criteria described herein and/or with one or more operating parameters 54 of vehicle 10. For example, in a tetherless criterion including the power-to-speed ratio, an orientation of vehicle 10 may be taken into consideration since the power-to-speed ratio may be affected by whether vehicle 10 is travelling on water, on substantially leveled ground, uphill or downhill.

In some embodiments, the inference of the reduction in weight carried by vehicle 10 as a tetherless criterion may be active only in certain operating conditions such as when the speed of vehicle 10 is greater than a speed threshold for example. In some embodiments, the inference of the reduction in weight carried by vehicle 10 as a tetherless criterion may include a persistence criterion where the sensed characteristic must be met for a minimum threshold time (e.g., one or more seconds) before the operator-vehicle separation condition may be detected.

Additionally or alternatively, the operator-vehicle separation condition may be detected in a tetherless manner by sensing an absence of an accelerator command via acceleration position sensor 42F. In some situations, the absence of an accelerator command may be indicative of the operator-vehicle separation condition. Data acquired from accelerator position sensor 42F may be communicated to controller 32 and used by controller 32 in a tetherless criterion including whether or not there is an absence of the accelerator command.

In some embodiments, the absence of the accelerator command may be used in combination with one or more other tetherless criteria described herein and/or with one or more operating parameters 54 of vehicle 10. In some embodiments, the absence of the accelerator command as a tetherless criterion may be active only in certain operating conditions. In some embodiments, the absence of the accelerator command as a tetherless criterion may include a persistence criterion where the sensed characteristic must be met for a minimum threshold time (e.g., one or more seconds) before the operator-vehicle separation condition may be detected.

Additionally or alternatively, the operator-vehicle separation condition may be detected in a tetherless manner using optical sensor 42D, thermal sensor 42H and/or other type of proximity sensor(s) operatively connected to controller 32 and aimed toward a location expected to be occupied by the operator above seat 13. For instance, optical sensor 42D and/or thermal sensor 42H may be disposed on handlebar 19, on a console or other body panel of vehicle 10 to monitor the operator's presence on vehicle 10. Data acquired from optical sensor 42D and/or thermal sensor 42H may be communicated to controller 32 and used by controller 32 in a tetherless criterion including whether the operator is present or absent from the location expected to be occupied by the operator.

In some embodiments, the absence of the operator from the location expected to be occupied may be used in combination with one or more other tetherless criteria described herein and/or with one or more operating parameters 54 of vehicle 10. In some embodiments, the absence of the operator from the location expected to be occupied as a tetherless criterion may be active only in certain operating conditions. In some embodiments, the absence of the operator from the location expected to be occupied as a tetherless criterion may include a persistence criterion where the sensed characteristic must be met for a minimum threshold time (e.g., one or more seconds) before the operator-vehicle separation condition may be detected.

Additionally or alternatively, the operator-vehicle separation condition may be detected in a tetherless manner using gyroscope 42G or other suitable sensor configured to sense an (e.g., non-upright, upright, levelled, uphill, downhill) orientation of vehicle 10. For example, a non-upright orientation of vehicle 10 may be indicative of the operator-vehicle separation condition and/or may be indicative of a condition where the operator's ability to operate the vehicle 10 is compromised and warrants preventing propulsion of vehicle 10 via system 40. Data acquired from gyroscope 42G may be communicated to controller 32 and used by controller 32 in a tetherless criterion including whether vehicle 10 is in an upright or non-upright orientation.

In some embodiments, the non-upright orientation of vehicle 10 may be used in combination with one or more other tetherless criteria described herein and/or with one or more operating parameters 54 of vehicle 10. In some embodiments, the non-upright orientation of vehicle 10 as a tetherless criterion may be active only in certain operating conditions. In some embodiments, the non-upright orientation of vehicle 10 as a tetherless criterion may include a persistence criterion where the sensed characteristic must be met for a minimum threshold time (e.g., one or more seconds) before the operator-vehicle separation condition may be detected.

Additionally or alternatively, the operator-vehicle separation condition may be detected in a tetherless manner by detecting the absence of a portable electronic device (PED) such as a smartphone, watch or other device that may be carried or worn by the operator. Such PED may be in wireless data communication (e.g., paired via Bluetooth®, or via near-field communication (NFC)) with controller 32 using Bluetooth® transceiver 421 or NFC antenna 42J to inform controller 32 of the proximity of operator via the PED as a proxy. The use of such PED may provide the ability to detect the operator becoming separated from vehicle 10 in case of a loss of communication between the PED and controller 32 and/or a decrease in signal strength from the PED perceived by controller 32 for example. For example, controller 32 may evaluate a tetherless criterion indicative of the operator-vehicle separation condition including whether a loss of communication between the PED and controller 32 has occurred and/or a decrease in signal strength from the PED has been perceived.

In some embodiments, the absence of the PED may be used in combination with one or more other tetherless criteria described herein and/or with one or more operating parameters 54 of vehicle 10. In some embodiments, the absence of the PED as a tetherless criterion may be active only in certain operating conditions. In some embodiments the absence of the PED as a tetherless criterion may include a persistence criterion where the sensed characteristic must be met for a minimum threshold time (e.g., one or more seconds) before the operator-vehicle separation condition may be detected.

In some embodiments, the combination of criteria used may be varied based on one or more operating parameters such as the speed of vehicle 10, or whether or not vehicle 10 is in cruise control. When not in cruise control, accelerator commands may be input manually by the operator. When vehicle 10 is in cruise control, accelerator commands may be provided automatically.

When an operating parameter 54 of vehicle 10 has a first value, detecting the operator-vehicle separation condition may be performed using a first tetherless criterion and optionally a second tetherless criterion. When the operating parameter 54 of vehicle 10 has a second value different from the first value, detecting the operator-vehicle separation condition may be performed using a third tetherless criterion and optionally a fourth tetherless criterion.

Figure 6:
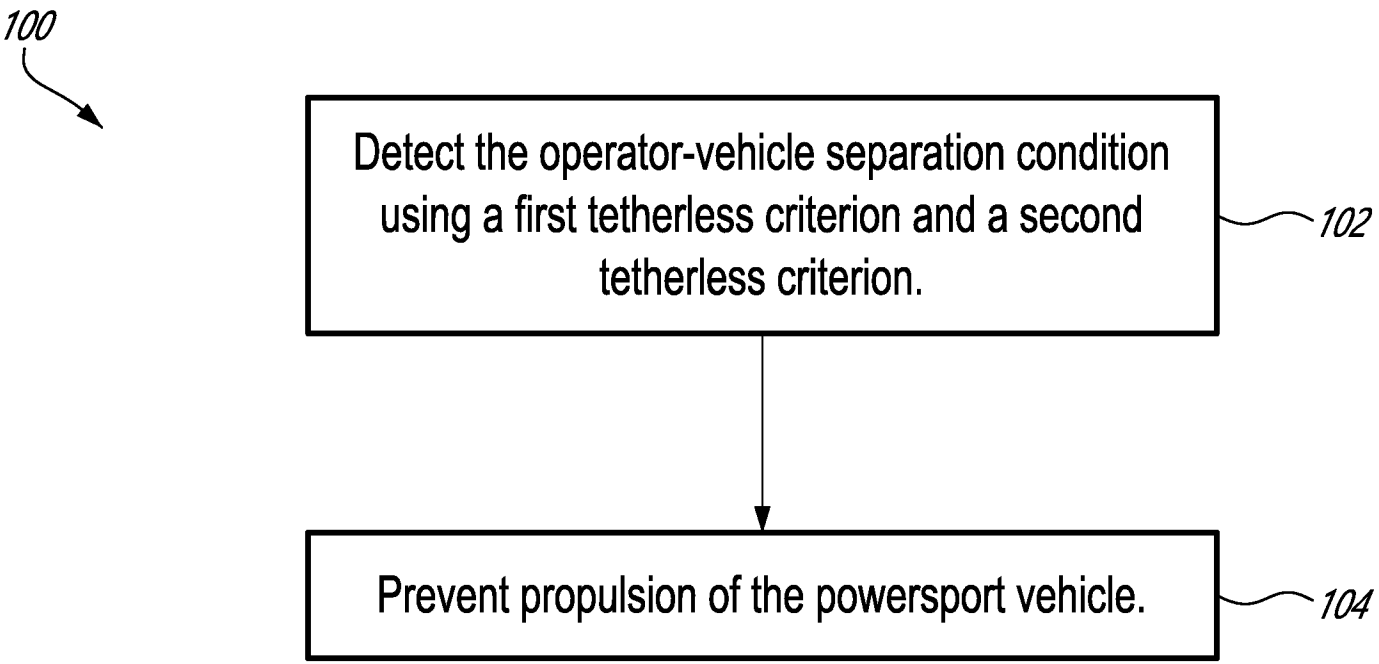
FIG. 6 shows a flow diagram of an exemplary method of operating a powersport vehicle during an operator-vehicle separation condition.

FIG. 6 shows a flow diagram of an exemplary method 100 of operating a powersport vehicle such as vehicle 10 during an operator-vehicle separation condition. Machine-readable instructions 60 may be configured to cause controller 32 to perform at least part of method 100. Aspects of method 100 may be combined with other actions or aspects of other methods described herein. Aspects of vehicles described herein may also be incorporated into method 100. In various embodiments, method 100 may include:

detecting the operator-vehicle separation condition using: a first tetherless criterion indicative of the operator-vehicle separation condition; and a second tetherless criterion indicative of the operator-vehicle separation condition, the second tetherless criterion being different from the first tetherless criterion (block 102); and in response to detecting the operator-vehicle separation condition using both the first tetherless criterion and the second tetherless criterion, preventing propulsion of vehicle 10 (block 104).

In some embodiments of method 100, vehicle 10 may be an electric powersport vehicle including motor 16 for vehicle 10. Preventing propulsion of vehicle 10 may include preventing propulsion of vehicle 10 via motor 16.

In various embodiments of method 100, the first and second criteria may be determined using one or more sensed characteristics from a single sensor 42 or 48A-48F, or from multiple sensors 42 or 48A-48F. For example, the first and second criteria may be determined from different values acquired via a single operator state sensor 42. In some embodiments, method 100 may include using first data acquired via a first sensor 42 or 48A-48F of a first type to detect the operator-vehicle separation condition using the first tetherless criterion. Method 100 may include using second data acquired via a second sensor 42 or 48A-48F of a second type to detect the operator-vehicle separation condition using the second tetherless criterion. In some embodiments, the first and second sensor types may be different to sense different characteristics.

The operator-vehicle separation condition may be detected based on an operating parameter of vehicle 10. The operating parameter may include a speed of vehicle 10. The operating parameter may include whether or not vehicle 10 is in a cruise control mode of operation where one or more accelerator command(s) are provided automatically.

The first tetherless criterion may include whether an absence of an operator's hand on handgrip 21 of vehicle 10 exists. The first tetherless criterion may include whether an absence of an operator's two hands on two respective handgrips 21 of vehicle 10 exists.

In various embodiments of method 100, the first tetherless criterion or the second tetherless criterion may include whether a decrease in weight carried by vehicle 10 exists. The decrease in weight carried by vehicle 10 may be inferred by detecting a decrease in power output of motor 16 relative to the speed of vehicle 10.

In various embodiments of method 100, the first tetherless criterion or the second tetherless criterion may include whether an absence of operator input to accelerator 34 of vehicle 10 exists. The absence of operator input to accelerator 34 may be used as a tetherless criterion when vehicle 10 is not in cruise control for example.

In various embodiments of method 100, the first tetherless criterion or the second tetherless criterion may include whether vehicle 10 has a non-upright orientation.

In various embodiments of method 100, the first tetherless criterion or the second tetherless criterion may include whether an absence of the PED proximal to (e.g., within communication range of) the vehicle 10 exists.

In various embodiments of method 100, the first tetherless criterion or the second tetherless criterion may include whether an absence of the operator from the location expected to be occupied by the operator exists.

The operator-vehicle separation condition may be detected using any combination of two or more criteria disclosed herein. For example, in some embodiments of method 100, the operator-vehicle separation condition may be detected using an absence of the operator's one or both hands on handgrips 21 as the first criterion combined with a decrease in weight on vehicle 10 as a second criterion. In some embodiments of method 100, the operator-vehicle separation condition may be detected using an absence of the operator's one or both hands on handgrips 21 as the first criterion combined with a non-upright orientation of vehicle 10 as a second criterion. In some embodiments of method 100, the operator-vehicle separation condition may be detected using an absence of the operator's one or both hands on handgrips 21 as the first criterion combined with an absence of the PED proximal to vehicle 10 as a second criterion. In some embodiments of method 100, the operator-vehicle separation condition may be detected using an absence of the operator's one or both hands on handgrips 21 as the first criterion combined with an absence of the operator from the location expected to be occupied by the operator on vehicle 10 as a second criterion. In some embodiments of method 100, the operator-vehicle separation condition may be detected using an absence of the operator from the location expected to be occupied by the operator on vehicle 10 as the first criterion combined with a decrease in weight on vehicle 10 as a second criterion.

In some embodiments of method 100, detecting the operator-vehicle separation condition using the first and second tetherless criteria may be performed when operating parameter 54 of vehicle 10 has a first value. However, when operating parameter 54 of vehicle 10 has a second value different from the first value, method 100 may include detecting the operator-vehicle separation condition using: a third tetherless criterion indicative of the operator-vehicle separation condition; and optionally a fourth tetherless criterion indicative of the operator-vehicle separation condition. The first, second, third and optionally fourth tetherless criteria may be different from each other.

In some embodiments of method 100, preventing propulsion of vehicle 10 may be conditioned upon one or more operating parameters 54 meeting certain conditions such as having predefined values or being within predefined ranges of values. For example, if the one or more operating parameter(s) 54 indicate a state of the vehicle 10 where preventing propulsion is not required (e.g., when the vehicle 10 is stationary or moving at low speed), then preventing propulsion may not be performed even though the one or more tetherless criterion may be satisfied. In some embodiments of method 100, if the one or more operating parameter(s) 54 indicate a state of the vehicle 10 where preventing propulsion is not required, then monitoring of the first and/or second tetherless criteria may not be performed.

For example, preventing propulsion of vehicle 10 may be conditioned upon the speed of vehicle 10 being greater than a threshold speed. In various embodiments, preventing propulsion of vehicle 10 may be performed when vehicle 10 is stationary, and/or may include preventing (e.g., interrupting) propulsion of vehicle 10 when vehicle 10 is in motion. The use of such speed threshold to activate the propulsion prevention mechanism may permit an operator to stand next to vehicle 10 (e.g., in case of vehicle 10 being a snowmobile, ATV or UTV) without necessarily having their hand(s) on handgrip(s) 21, actuate accelerator 34, and cause vehicle 10 to be propelled at a relatively slow speed over an obstacle and/or cause vehicle 10 to be propelled to become unstuck from deep snow, or loaded into a trailer or truck bed for example.

Figure 7:
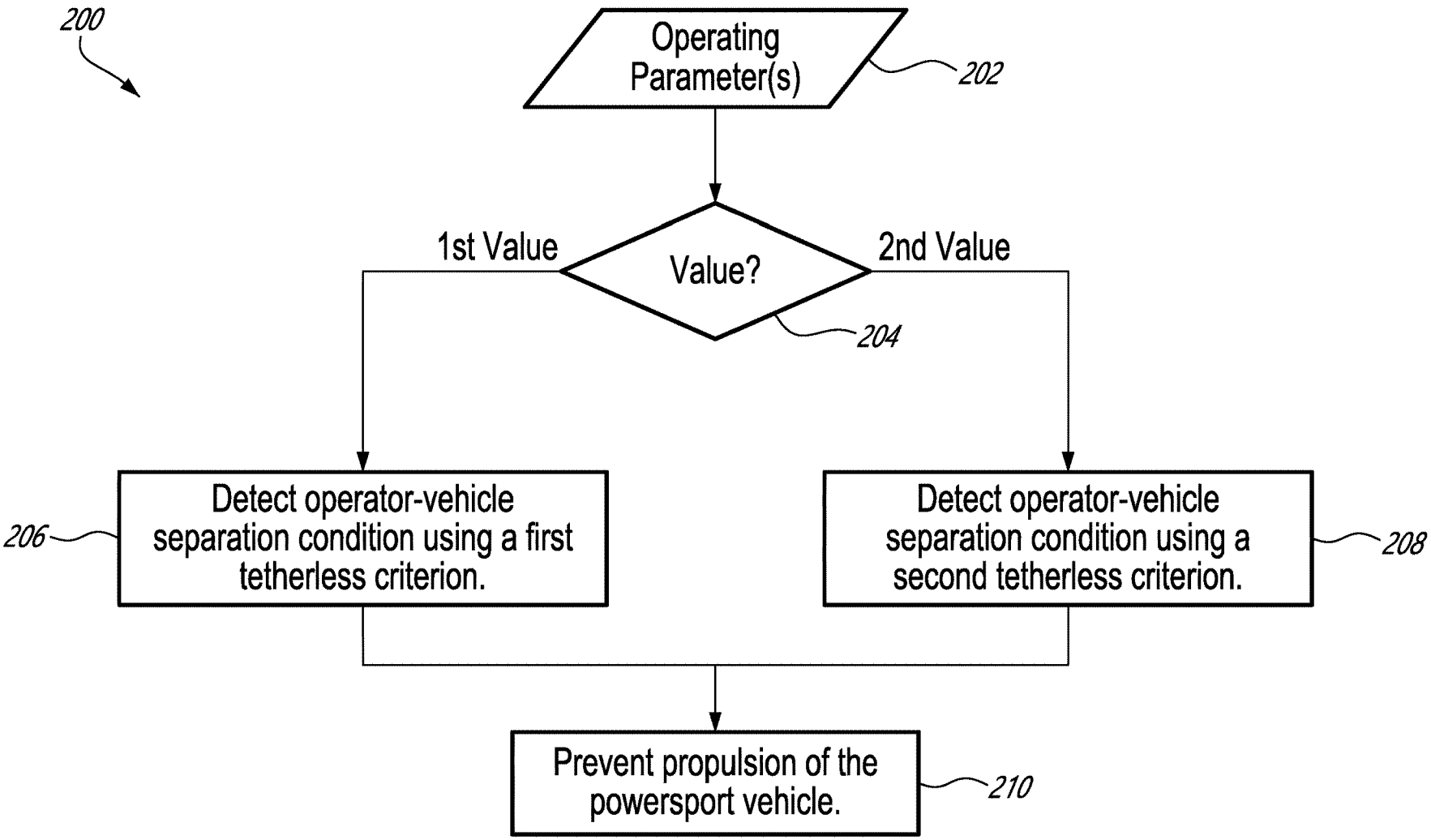
FIG. 7 shows a flow diagram of another exemplary method of operating a powersport vehicle during an operator-vehicle separation condition.

FIG. 7 shows a flow diagram of an exemplary method 200 of operating a powersport vehicle such as vehicle 10 during an operator-vehicle separation condition. Machine-readable instructions 60 may be configured to cause controller 32 to perform at least part of method 200. Aspects of method 200 may be combined with other actions or aspects of other methods described herein. Aspects of vehicles described herein may also be incorporated into method 200. In various embodiments, method 200 may include:

receiving operating parameter 54 of vehicle 10 (block 202);

when operating parameter 54 of vehicle 10 has a first value (block 204), detecting the operator-vehicle separation condition using a first tetherless criterion indicative of the operator-vehicle separation condition (block 206);

when operating parameter 54 of vehicle 10 has a second value different from the first value (block 204), detecting the operator-vehicle separation condition using a second tetherless criterion indicative of the operator-vehicle separation condition (block 208), the second tetherless criterion being different from the first tetherless criterion; and in response to detecting the operator-vehicle separation condition using the first tetherless criterion or the second tetherless criterion, preventing propulsion of the powersport vehicle (block 210).

In various embodiments, operating parameter 54 of vehicle 10 may include a speed of vehicle 10 and/or whether or not vehicle 10 is in a cruise control mode of operation. In the case of snowmobiles, ATVs or UTVs, the operating parameter 54 could be indicative of terrain conditions.

In various embodiments of the methods described herein, the first and second criteria may be determined using one or more sensed characteristics from a single operator state sensor 42 or from multiple sensors 42. For example, the first and second criteria may be determined from different values acquired via a single operator state sensor 42. Alternatively, the first and second criteria may be determined from values acquired via different respective operator state sensors 42. When different operator state sensors 42 are used for different criteria, operator state sensors 42 may be of a same type or of different types. For example, operator state sensors 42 of the same or of different types may be used to determine when the operator's one hand is absent from one handgrip 21, and/or to determine when the operator's two hands are absent from both handgrips 21. As an example of using a single weight sensor 42E, one tetherless criterion may include an absence of operator weight at one (e.g., low) operating speed of the vehicle 10, whereas another tetherless criterion may include only a reduction in operator weight (e.g., indicative of one of two or more passengers missing) at another (e.g., higher) operating speed of the vehicle 10.

In some embodiments, when the speed of vehicle 10 has the first value, the first criterion may include whether an absence of an operator's hand on a handgrip of vehicle 10 exists.

In some embodiments, when the speed of vehicle 10 has the first value, the first criterion may include whether an absence of operator input to accelerator 34 of vehicle 10 exists.

In some embodiments, when the speed of vehicle 10 has the second value and the second value is higher than the first value, the second criterion may include whether vehicle 10 has a non-upright orientation.

In some embodiments, when the speed of vehicle 10 has the second value and the second value is higher than the first value, the second criterion may be indicative of an output power of motor 16 propelling vehicle 10.

Figure 8:
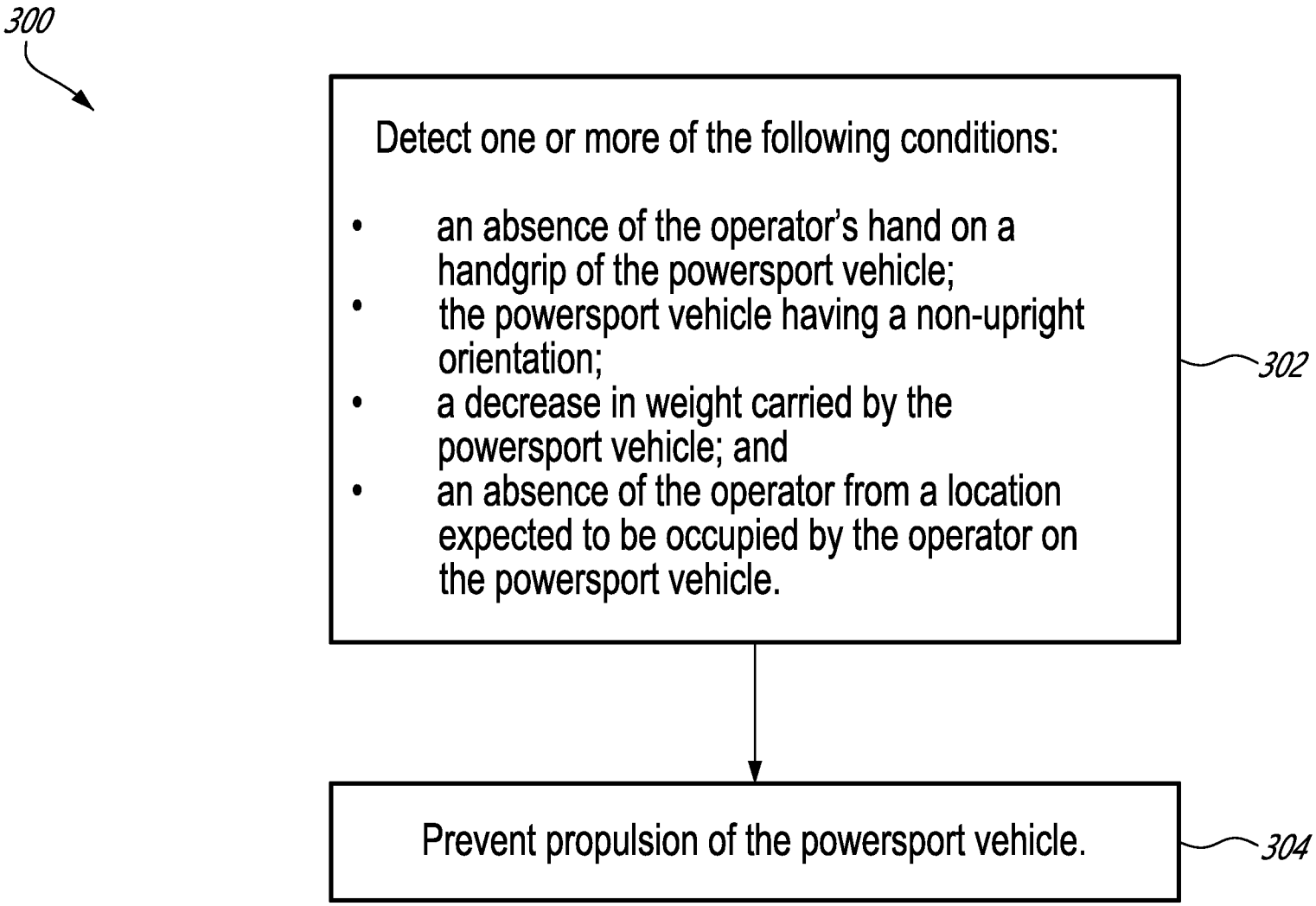
FIG. 8 shows a flow diagram of an exemplary method of operating a powersport vehicle when an operator's ability to safely operate the powersport vehicle is compromised.

FIG. 8 shows a flow diagram of a method of operating vehicle 10 or other powersport vehicle when an operator's ability to safely operate vehicle 10 is compromised. Machine-readable instructions 60 may be configured to cause controller 32 to perform at least part of method 300. Aspects of method 300 may be combined with other actions or aspects of other methods described herein. Aspects of vehicles described herein may also be incorporated into method 300. In various embodiments, method 300 may include:

detecting one or more of the following conditions:

an absence of the operator's hand on handgrip 21 of vehicle 10;

vehicle 10 having a non-upright orientation;

a decrease in weight carried by vehicle 10; and an absence of the operator from a location expected to be occupied by the operator on vehicle 10 (block 302); and in response to detecting the one or more conditions, preventing propulsion of vehicle 10 (block 304).

In some embodiments of method 300, the one or more conditions may include an absence of the operator's two hands on two respective handgrips 21 of vehicle 10.

In some embodiments of method 300, preventing propulsion of vehicle 10 may be conditioned upon a speed of vehicle 10 being greater than a threshold speed. In some embodiments of method 300, detecting the one or more conditions may be conditioned upon the speed of vehicle 10 being greater than the threshold speed. In some embodiments of method 300, preventing propulsion of vehicle 10 may be conditioned upon vehicle 10 being propelled by motor 16 when the one or more conditions are detected.

In some embodiments, one or more of the conditions may each include an optional persistence criterion including a minimum time threshold during which the condition must be true in order to be detected. Such persistence criterion may help prevent false-positives and nuisance interruptions associated with the normal operation of vehicle 10.

The embodiments described in this document provide non-limiting examples of possible implementations of the present technology. Upon review of the present disclosure, a person of ordinary skill in the art will recognize that changes may be made to the embodiments described herein without departing from the scope of the present technology. Further modifications could be implemented by a person of ordinary skill in the art in view of the present disclosure, which modifications would be within the scope of the present technology.

What is claimed is:

1. A method of operating a powersport vehicle during an operator-vehicle separation condition, the method comprising:

when an operating parameter of the powersport vehicle has a first value, detecting the operator-vehicle separation condition using a first tetherless criterion indicative of the operator-vehicle separation condition;

when the operating parameter of the powersport vehicle has a second value different from the first value, detecting the operator-vehicle separation condition using a second tetherless criterion indicative of the operator-vehicle separation condition, the second tetherless criterion being different from the first tetherless criterion; and in response to detecting the operator-vehicle separation condition using the first tetherless criterion or the second tetherless criterion, preventing propulsion of the powersport vehicle.

2. The method as defined in claim 1, wherein:

the powersport vehicle is an electric powersport vehicle including an electric motor for propelling the powersport vehicle; and preventing propulsion of the powersport vehicle includes preventing propulsion of the powersport vehicle via the electric motor.

3. The method as defined in claim 1, wherein the operating parameter of the powersport vehicle includes a speed of the powersport vehicle.

4. The method as defined in claim 3, wherein when the speed of the powersport vehicle has the first value, the first tetherless criterion includes whether an absence of an operator's hand on a handgrip of the powersport vehicle exists.

5. The method as defined in claim 3, wherein when the speed of the powersport vehicle has the first value, the first tetherless criterion includes whether the powersport vehicle has a non-upright orientation.

6. The method as defined in claim 3, wherein when the speed of the powersport vehicle has the first value, the first tetherless criterion includes whether an absence of a portable electronic device (PED) proximal to the powersport vehicle exists.

7. The method as defined in claim 3, wherein when the speed of the powersport vehicle has the second value and the second value is higher than the first value, the second tetherless criterion includes whether the powersport vehicle has a non-upright orientation.

8. The method as defined in claim 3, wherein when the speed of the powersport vehicle has the second value and the second value is higher than the first value, the second tetherless criterion includes whether a decrease in weight carried by the powersport vehicle exists.

9. The method as defined in claim 3, wherein when the speed of the powersport vehicle has the second value and the second value is higher than the first value, the second tetherless criterion includes whether an absence of an operator from a location expected to be occupied by the operator exists.

10. The method as defined in claim 3, wherein when the speed of the powersport vehicle has the second value and the second value is higher than the first value, the second tetherless criterion includes whether an absence of one or both operator's hands on handgrips of the powersport vehicle exists.

11. The method as defined in claim 1, wherein:

the first value of the operating parameter of the powersport vehicle is indicative of a first mode of operation of the powersport vehicle, the first mode of operation requiring a manual accelerator command to be input manually by an operator; and the second value of the operating parameter of the powersport vehicle is indicative of a second mode of operation of the powersport vehicle, the second mode of operation including an automatic accelerator command to be provided automatically.

12. A tetherless system for operating a powersport vehicle during an operator-vehicle separation condition, the tetherless system comprising:

a first sensor operative to sense a first tetherless characteristic indicative of the operator-vehicle separation condition;

a second sensor operative to sense a second tetherless characteristic indicative of the operator-vehicle separation condition, the second tetherless characteristic being different from the first tetherless characteristic;

one or more data processors operatively connected to the first and second sensors; and non-transitory machine-readable memory storing instructions executable by the one or more data processors and configured to cause the one or more data processors to:

when an operating parameter of the powersport vehicle has a first value, detect the operator-vehicle separation condition using the sensed first tetherless characteristic;

when the operating parameter of the powersport vehicle has second value different from the first value, detect the operator-vehicle separation condition using the sensed second tetherless characteristic; and in response to detecting the operator-vehicle separation condition using the first tetherless characteristic or the second tetherless characteristic, cause propulsion of the powersport vehicle to be prevented.

13. The tetherless system as defined in claim 12, wherein the operating parameter of the powersport vehicle includes a speed of the powersport vehicle.

14. The tetherless system as defined in claim 13, wherein when the speed of the powersport vehicle has the first value, the first tetherless characteristic includes an absence of an operator's hand on a handgrip of the powersport vehicle.

15. The tetherless system as defined in claim 13, wherein when the speed of the powersport vehicle has the second value and the second value is higher than the first value, the second tetherless characteristic includes a non-upright orientation of the powersport vehicle.

16. The tetherless system as defined in claim 13, wherein when the speed of the powersport vehicle has the second value and the second value is higher than the first value, the second tetherless characteristic is indicative of a decrease in weight carried by the powersport vehicle.

17. The tetherless system as defined in claim 13, wherein when the speed of the powersport vehicle has the second value and the second value is higher than the first value, the second tetherless characteristic is indicative of whether an absence of an operator from a location expected to be occupied by the operator exists.

18. The tetherless system as defined in claim 12, wherein:

the first value of the operating parameter of the powersport vehicle is indicative of a first mode of operation of the powersport vehicle, the first mode of operation requiring a manual accelerator command to be input manually by an operator; and the second value of the operating parameter of the powersport vehicle is indicative of a second mode of operation of the powersport vehicle, the second mode of operation including an automatic accelerator command to be provided automatically.

19. A powersport vehicle comprising the tetherless system as defined in claim 12.

20. A tetherless system for preventing propulsion of a powersport vehicle during an operator-vehicle separation condition, the tetherless system comprising:

a first sensor operative to sense a first tetherless characteristic indicative of the operator-vehicle separation condition;

a second sensor operative to sense a second tetherless characteristic indicative of the operator-vehicle separation condition, the second tetherless characteristic being different from the first tetherless characteristic;

one or more data processors operatively connected to the first and second sensors; and non-transitory machine-readable memory storing instructions executable by the one or more data processors and configured to cause the one or more data processors to:

when a first mode of operation of the powersport vehicle requires a manual accelerator command to be input manually by an operator to propel the vehicle, detect the operator-vehicle separation condition using the sensed first tetherless characteristic;

when a second mode of operation of the powersport vehicle requires an automatic accelerator command to be provided automatically to propel the vehicle, detect the operator-vehicle separation condition using the sensed second tetherless characteristic; and in response to detecting the operator-vehicle separation condition, cause propulsion of the powersport vehicle to be prevented.

* * * * *